United States Patent [19]

Price

[11] 4,236,449

[45] Dec. 2, 1980

[54] PASTER PILOT SENSOR FOR PRESS

[75] Inventor: Earl T. Price, San Jose, Calif.

[73] Assignee: Earl T. Price, San Jose, Calif.

[21] Appl. No.: 43,525

[22] Filed: May 29, 1979

[51] Int. Cl.[3] ..... B65H 19/16; B65H 25/04; B65H 25/10; B65H 25/28

[52] U.S. Cl. ..... 101/228; 242/57; 242/58.1; 324/175

[58] Field of Search ..... 101/219, 228, 220–227, 101/181; 242/57, 57.1, 58.1, 58.2, 58.3, 58.4, 58.5, 58.6; 156/504, 502; 324/175; 226/100; 250/231 SE, 233, 239; 356/28

[56] References Cited

U.S. PATENT DOCUMENTS

| | | | |
|---|---|---|---|
| 2,196,612 | 4/1940 | Scott | 242/58.1 |
| 2,939,646 | 6/1960 | Stone | 242/58.2 |
| 2,963,234 | 12/1960 | Chase et al. | 242/58.3 |
| 3,123,316 | 3/1964 | Hornbostel, Jr. | 242/58.4 |
| 3,409,242 | 11/1968 | Kishioka | 242/57 X |
| 3,633,835 | 1/1972 | Beers | 242/57 X |
| 3,693,023 | 9/1972 | Wasserman | 324/175 X |
| 3,771,737 | 11/1973 | Swann | 242/58.1 |
| 3,775,223 | 11/1973 | Moseley | 242/58.1 X |
| 4,021,002 | 5/1977 | Melhofer | 242/58.1 |
| 4,047,106 | 9/1977 | Robinson | 324/175 |
| 4,077,580 | 3/1978 | Lang et al. | 242/58.2 |

FOREIGN PATENT DOCUMENTS

| | | | |
|---|---|---|---|
| 701486 | 1/1965 | Canada | 242/58.1 |
| 1138404 | 10/1962 | Fed. Rep. of Germany | 242/58.1 |

*Primary Examiner*—J. Reed Fisher
*Attorney, Agent, or Firm*—Townsend and Townsend

[57] ABSTRACT

A device for sensing speed and angular position of a web of newprint in a continuous feed press. A stator includes an optical source and an optical sensor. A rotor has an aperture of predetermined size and position which is operative as a shutter to block and unblock the optical path between the optical source and sensor. The device provides a speed and position signals without commutator contacts which are subject to rapid wear and which require frequent maintenance.

3 Claims, 2 Drawing Figures

PASTER PILOT SENSOR FOR PRESS

BACKGROUND OF INVENTION

1. Field of Invention

This invention relates to a sensing device for use in high-speed continuous paper feeding printing presses. In particular, the invention relates to a hub speed sensor for a roll of paper for use in a system which automatically joins the newsprint of a spent web to the newsprint of a fresh web in an operating printing press environment.

High volume presses, such as letterpress type presses used in newspaper printing, require continuous feed of newsprint. A press run generally consumes much more paper than is provided in a single roll of newsprint. In order to prevent frequent disruption of press runs, machines have been developed for automatically joining fresh newsprint webs to spent webs during a press run while newsprint if feeding at a rate of several hundred feet per minute. A letterpress having a press feeding system with this capability is the Goss brand continuous roll newspaper printing presses manufactured by MGD Graphic Systems of Chicago, Il.

The Goss type newspaper presses have a web feeding system employing a three pointed star wheel assembly having three hubs for supporting three webs of newsprint. The star wheel assembly is rotated about a central axis so that at any one time a first web can be feeding, a second web can be standing by and a third web, if spent, can be unloaded and the hub can be reloaded with a fresh web.

In operation, a newsprint web feeds at such a high speed that a mechanism must be provided for automatically sensing the approaching exhaustion of a web and for automatically attaching the fresh web to the nearly spent web. This process operates as follows. A sensor is provided to sense the impending run-out of the newsprint web in feed to the presses. At a predetermined signal or series of signals prior to web run-out, the second newsprint web is rotated on the star wheel assembly into a position in near tangent to the newsprint feed path. The fresh web is spun up to feed speed and synchronized with the newsprint feed. At a second signal or predetermined set of signals indicating speed and position synchronism between the beginning of the fresh web and the newsprint feed path, the newsprint feed is slapped against the second web and cleaved from the nearly exhausted feed web. The pressure against the second web causes an adhesive paste on the beginning of the second web to seize the end of the newsprint feed of the previous web, thereby providing an uninterrupted newsprint feed. The exhausted web of the star wheel can thereafter be removed and the hub can be reloaded so that a fresh web is available for subsequent use.

2. Description of the Prior Art

A hub speed sensor, or paster pilot sensor, is critical to the accurate operation of the changeover from a spent web to a fresh web. The hub speed sensor, called a paster pilot sensor, is provided at each web hub of the star wheel. The hub speed sensor operates like a tachometer to provide a signal to a central controller which directs changeover operation. However, the hub speed sensor is both speed and position sensitive. In the prior art, the continuous high-speed presses have employed a commutator brush assembly with rotary contacts of selected lengths to generate needed hub speed and position signals. The previously known commutator brush hub speed sensor required frequent maintenance and has been subject to frequent mechanical failures due to contact wear and exposure to ambient contaminants. Due to the high rotational speed and relatively heavy daily use, contacts wear out quickly, causing loss of signal and occasionally expensive and time consuming press run breakdowns. Consequently there is a need for a reliable hub speed sensor.

SUMMARY OF THE INVENTION

A hub speed or paster pilot sensor in a continuous paper feed printing press generates a speed and position signal without electrical contacts. The paster pilot sensor comprises an annular stator, in which is mounted an optical radiation source and detector, and an annular rotor which is mounted to the web hub. The rotor includes an aperture of predetermined size and position which serves as a shutter for blocking and unblocking the optical path between the optical sensor and detector.

It is an object of this invention to eliminate position and speed signal losses due to mechanical failure of electrical contacts in a paster pilot sensor.

It is a further object of the invention to provide a self-cleaning paster pilot sensor substantially immune to ambient contaminants.

Other objects and advantages of this invention will be apparent from the following detailed description of specific embodiments taken in conjunction with the following detailed drawings.

DETAILED DESCRIPTION OF SPECIFIC EMBODIMENTS

Figure 1:
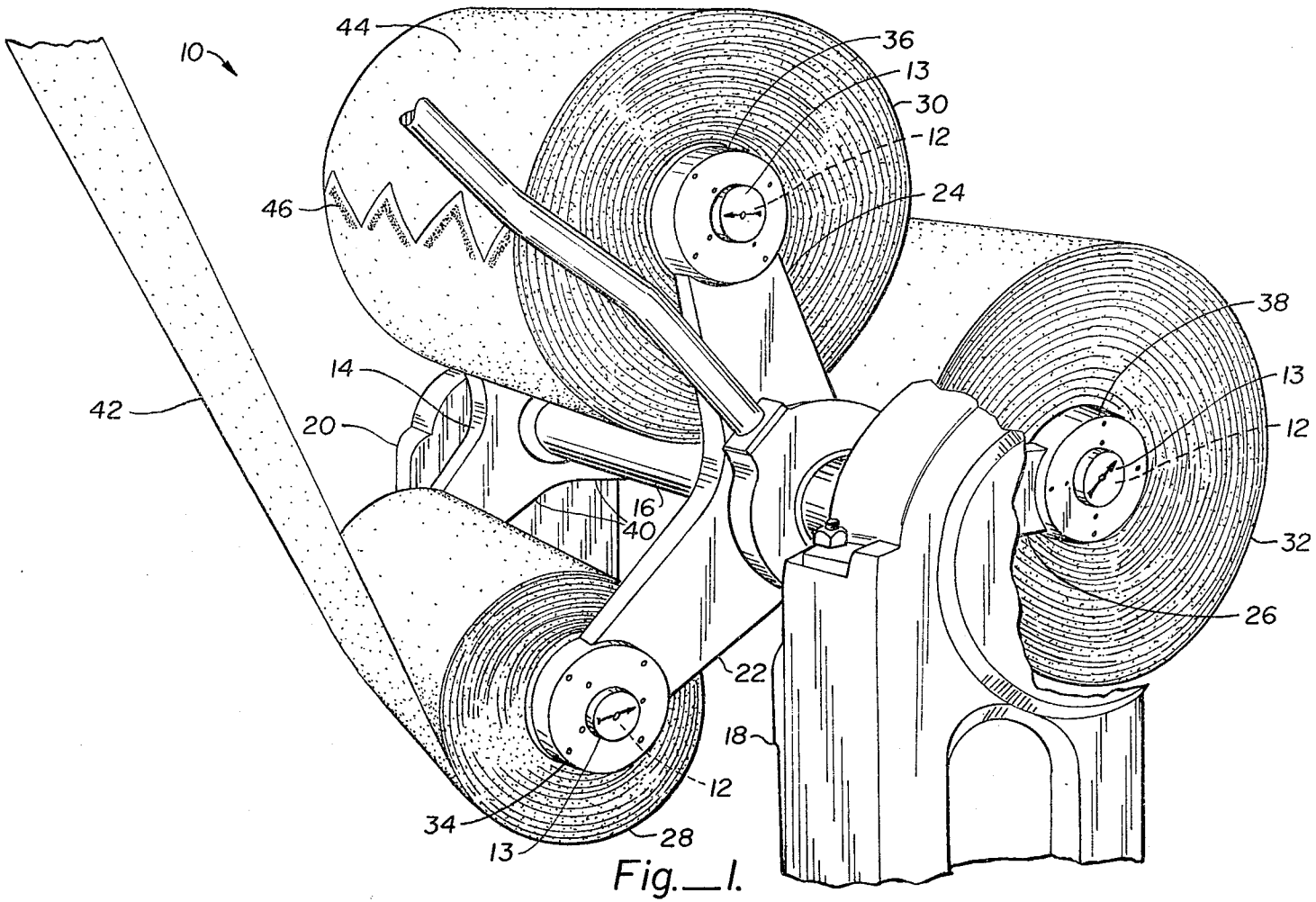
FIG. 1 is a perspective view illustrating a star wheel paper feed assembly employing a plurality of paster pilot sensors.

FIG. 1 illustrates a paper feed assembly 10 in which paster pilot sensors 12 are employed. (The sensors 12 are each covered by a hub end dust cap 13. An arrow on the dust cap 13 designates the orientation of the sensor 12.)

The paper feed assembly 10 comprises a threeelement star wheel 14 supported by a central shaft 16 between first and second geared supports 18, 20. Each arm 22, 24, 26 supports one web 28, 30, 32 of newsprint, respectively, on a hub 34, 36, 38. A matching set of three arms 40 and three hubs (not shown) supports the opposite end of each web 28, 30, 32.

The first web 28 is operative to provide a newprint feed 42 to presses (not shown). As the first web 28 is exhausted, the second web 30 is rotated on the star wheel assembly 14 to a point where its surface 44 is almost tangential with the newsprint feed 42. A pattern of adhesive paste 46 along the lead of the second web 30 is provided for attaching the lead of the second web 30 to the tail of the first web 28. For this purpose, the second web 30 is spun up to a speed synchronous with the speed of the first web 28. Speed and angular position information of the first web 28 and the second web 30 are derived from signals generated by the paster pilot sensors 12, as discussed hereafter in greater detail.

Figure 2:
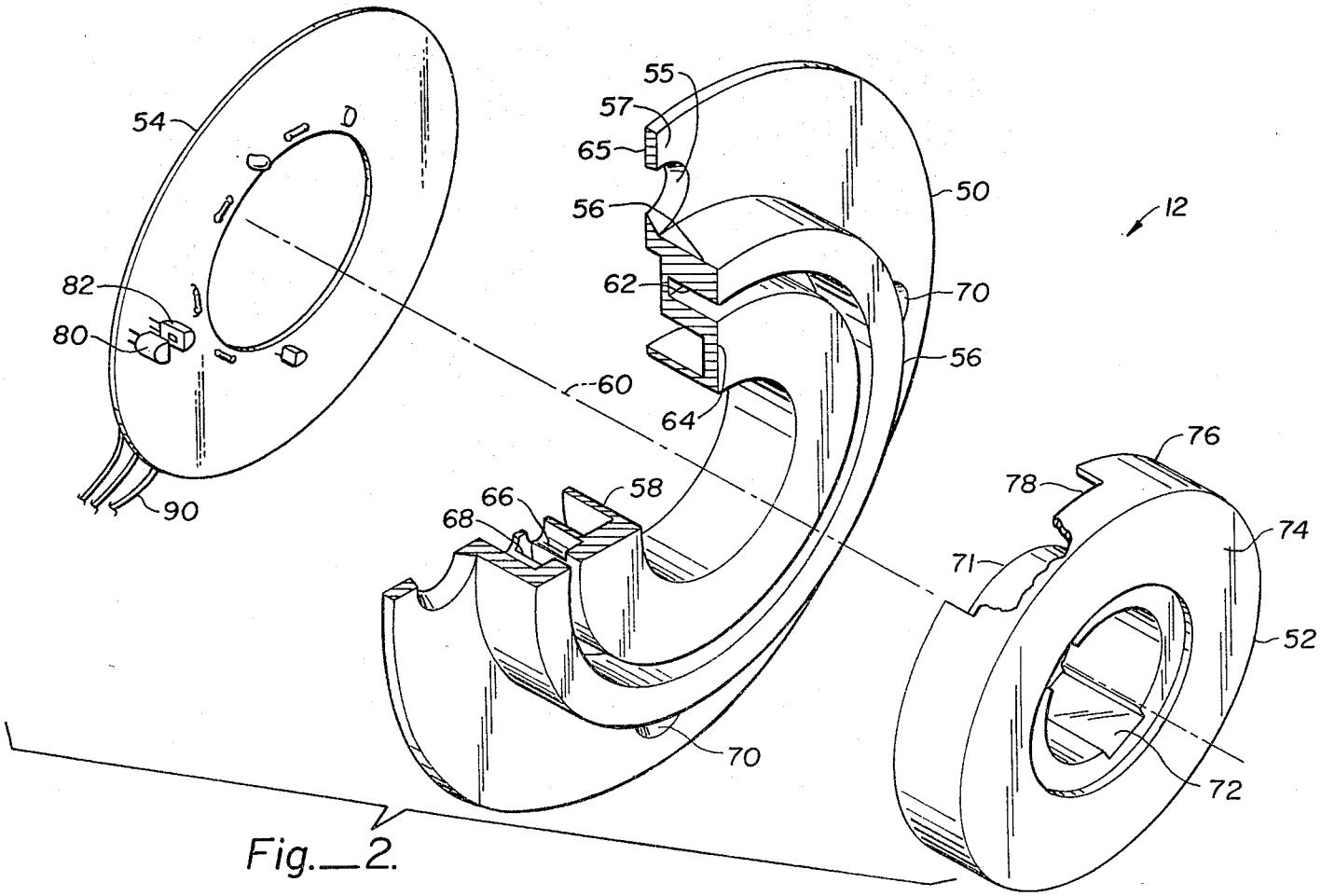
FIG. 2 is a perspective view in partial cutaway illustrating a paster pilot sensor.

Referring to FIG. 2, the paster pilot sensor 12 is illustrated in detail. The sensor 12 comprises a stator 50, a rotor 52 and a circuit board 54. The stator 50 is an annular plate with a flange 55 and a shoulder 56 on the front side 57 about a circular opening 58 centered around a central axis 60. The shoulder 56 defines the outside portion of an annular slot 62 concentrically located with respect to the axis 60.

The inside portion of the slot 62 is defined by an inner ring 64. On the opposing side 65 of the stator 50 the portion defining the inner ring 64 is recessed to serve as a housing cover accommodating, for example, electronic circuit components.

At the outwardly disposed margin of the inner ring 64 bordering on the slot 62 there is provided a first cavity 66 which is open to the slot 62 and to the opposing stator side 65. Directly opposite the first cavity 66, that is, on a radius through the central axis 60, in the inner margin of the shoulder 56 bordering on the slot 62, there is a second cavity 68. The second cavity 68 is open to the slot 62 and to the opposing stator side 65.

Means are provided for mounting the stator to a stationary mount. For example, counterbored holes 70 are provided in the flange 55, which mate with a threaded mount of a fixed backing plate (not shown).

The rotor 52 is an annulus with a hub mount 71 and keyway 72 in a central opening 74. The keyway 72 allows the rotor 52 to be fixedly mounted to a rotatable hub extending through the stator central opening 58. The rotor 52 comprises a disk portion 74 and a lip portion 76. The disk portion extends radially outwardly of the central axis about which the hub mount 71 is located, and the lip portion 76 extends from the disk portion 74 parallel to the axis 60 in a circular arc around the hub mount 71. The diameter of the circular arc corresponds to the diameter of the station slot 62, and the thickness of the lip portion 76 is less than the radial width of the slot 62.

The lip portion 76 is thus able to be placed within the stator slot 62 at any rotational angle parallel to the axis 60. The lip portion 76 would thus block an open optical path between opposing first and second cavities 66 and 68.

The lip portion 76, however, has an aperture 78 along a segment. Preferably the aperture 78 is a cutout about 30 degrees of arc in length. The aperture 78 is located at a predetermined position relative to the keyway 72. In operation the rotor 52 turns relative to the stator 50 around the axis 60 with the lip portion 76 in the slot 62. The aperture is operative to unblock the optical path between cavities 66 and 68 for a predetermined segment of each revolution of the lip portion 76.

Suitable circuitry is mounted on the circuit board 54. The board 54 is a relatively flat annulus for which the stator 50 serves as a protective cover. Specifically, an optical radiation source 80, such as a light emitting diode, is mounted on the board 54 and disposed in the second cavity 68 for directing optical radiation from the second cavity 68 to the first cavity 66. In the first cavity 66 is mounted an optical radiation detector 82, such as photodetector sensitive to the output of the radiation source 80. The detector 82 produces a signal whenever radiation is incident thereon, that is, whenever the aperture is in position to unblock the radiation source 80.

The rotation of the rotor 52 attached to the hub (not shown) of the newsprint web (FIG. 1) with respect to the stator 50, which is mounted to a stationary support (not shown), produces detectable signals indicating speed and position.

Speed is determined by pulses per unit time which are calibrated to the diameter and surface speed of the web. Position is indicated by the relative location of the aperture 78 and the cavities 66, 68. The resultant signals are conveyed via signal wires 90 to a control panel or panels for decoding and actuation of the paster functions.

The lip portion 76 serves an additional function of maintaining the cleanliness of the slot 62. The lip portion 76 substantially fills the slot 62. When rotated at high speed, it sweeps the slot clean by pushing pressurized air through the slot 62.

The invention has now been explained in connection with a specific embodiment. Other embodiments will be apparent to those of ordinary skill in this art. Accordingly, the invention is not intended to be limited except as indicated by the appended claims.

What is claimed is:

1. In a continuous paper feed printing press having a paper feeder with a rotary hub and a stationary mount, a pilot sensor for generating a signal indicative of hub rotation speed and position comprising:

an annular stator for mounting to said stationary mount about said hub, said stator including means defining an annular slot concentric with respect to a central axis through said stator, said slot-defining means comprising an inner ring and an outer ring, means defining a cavity in said inner ring at an outwardly disposed margin and said slot and having a first opening to said slot, and means defining a second cavity in said outer ring at an inwardly disposed margin of said slot and having a second opening to said slot such that said first opening opposes said second opening on a radius through said central axis;

a rotor including means for fixedly mounting said rotor to said hub, said rotor comprising an annular disk portion extending radially of a central axis and an annular lip portion adjoining said annular section, said lip portion extending parallel to said axis and concentrically about said axis, said lip portion being adapted to be placed within said stator slot at any relative rotational angle when said rotor is mounted to said hub and when said stator is affixed to said stationary mount for blocking said first opening from said second opening, said rotor further including means defining an aperture circumferentially in said lip portion of a predetermined circumferential extent and of a predetermined radial location relative to said predetermined hub angular position, said aperture being operative to unblock said first opening from said second opening for a predetermined angular displacement of said hub;

an optical radiation source disposed within one of said cavities for directing radiation from one of said openings to the other one of said openings; and an optical radiation detector disposed in the other one of said cavities for receiving and sensing optical radiation from said optical radiation source whenever said aperture unblocks said first opening from said second opening for producing a signal indicative of rotational speed and rotational position of said hub.

2. The pilot sensor as claimed in claim 1 wherein said lip portion substantially fills said slot and said disk portion substantially covers said slot for cleaning said slot and for inhibiting accumulation of ambient contaminants in said slot upon motion of said rotor relative to said stator.

3. The pilot sensor as claimed in claim 2 wherein said stator further includes an annular cavity about said central axis within said inner ring on a side opposing said slot for encasing signal transmission circuitry which is operative to convey signals from said detector to a central controller.

* * * * *